US007836620B2

(12) United States Patent
Cole

(10) Patent No.: US 7,836,620 B2
(45) Date of Patent: Nov. 23, 2010

(54) ANIMATED MEDIA AND METHODS OF CONSTRUCTION

(75) Inventor: Jeffrey Charles Cole, Arvada, CO (US)

(73) Assignee: Andrews McMeel Publishing, LLC, Kansas City, MO (US)

( * ) Notice: Subject to any disclaimer, the term of this patent is extended or adjusted under 35 U.S.C. 154(b) by 281 days.

(21) Appl. No.: 12/176,805

(22) Filed: Jul. 21, 2008

(65) Prior Publication Data

US 2010/0011636 A1 Jan. 21, 2010

(51) Int. Cl.
*G09F 19/00* (2006.01)

(52) U.S. Cl. ..... 40/445; 40/124.09; 446/150

(58) Field of Classification Search ..... 40/445, 40/124.09, 124.08; 446/147, 149, 150, 151; 434/405

See application file for complete search history.

(56) References Cited

U.S. PATENT DOCUMENTS

| | | | | | |
|---|---|---|---|---|---|
| 418,135 | A * | 12/1889 | Kaufmann | ..... | 40/491 |
| 944,385 | A | 12/1909 | Spiegel | | |
| 946,407 | A * | 1/1910 | Spiegel | ..... | 40/445 |
| 1,211,497 | A * | 1/1917 | Spiegel | ..... | 40/445 |
| 1,259,297 | A * | 3/1918 | Russell | ..... | 40/445 |
| 2,367,967 | A * | 1/1945 | Schwartz | ..... | 40/445 |
| 2,398,257 | A | 4/1946 | Schwartz | | |
| 2,749,657 | A | 6/1956 | Lohnes | | |
| 3,191,328 | A | 6/1965 | Lohnes | | |
| 3,918,185 | A | 11/1975 | Hasala | | |
| 4,151,541 | A | 4/1979 | Roger | | |
| 5,901,484 | A | 5/1999 | Seder | | |
| 6,311,142 | B1 | 10/2001 | Glassner | | |
| 6,732,459 | B1 | 5/2004 | Clark | | |
| 7,151,541 | B2 | 12/2006 | Seder | | |
| 2003/0154637 | A1 * | 8/2003 | Kainen | ..... | 40/124.09 |

* cited by examiner

*Primary Examiner*—Gary C Hoge
(74) *Attorney, Agent, or Firm*—Lathrop & Gage LLP

(57) ABSTRACT

Animated printed media (e.g., greeting cards, books, etc.) are disclosed herein. An animated printed medium according to one embodiment includes two pages that define a pocket therebetween. At least one of the pages has a window with a plurality of spaced apart transparent sections, and a push-sleeve is coupled to an element that is rotatable relative to the two pages. The pushsleeve extends in the pocket and has a coded image positioned to move beneath the window. A fold line is between the pushsleeve and the element to allow the pushsleeve to rotate relative to the element. The pushsleeve is movable between a first position where the element is between the fold line and the window and a second position where the fold line is between the element and the window. Movement of the pushsleeve between the first and second positions causes the coded image to move beneath the window.

20 Claims, 17 Drawing Sheets

FIG. 2a
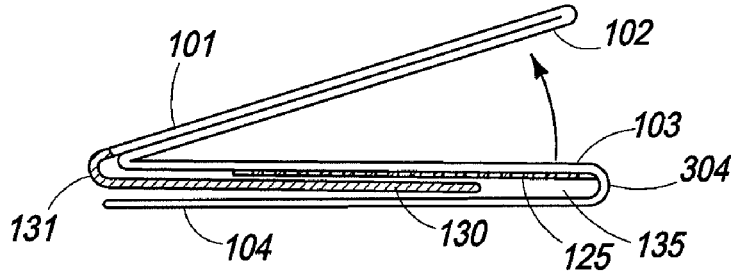
FIG. 2b
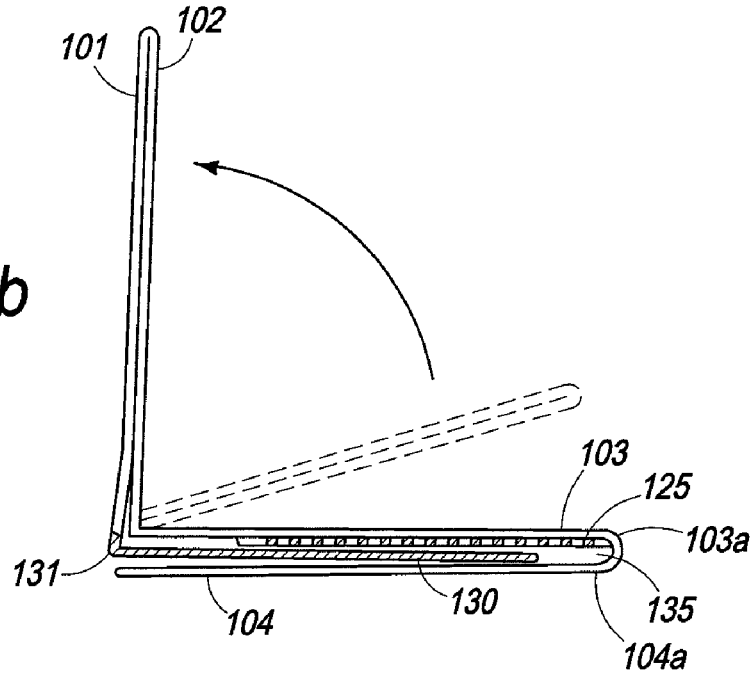
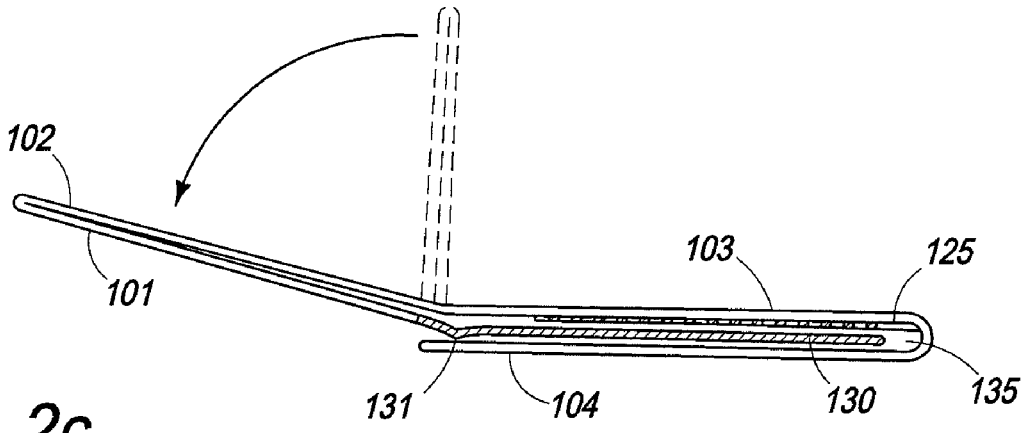
FIG. 2c

ANIMATED MEDIA AND METHODS OF CONSTRUCTION

BACKGROUND

Advances to animated media (e.g., greeting cards, books, etc.) are provided that do not require electricity to effect the animation.

SUMMARY

An animated printed medium according to one embodiment includes two pages that define a pocket therebetween. At least one of the pages has a window with a plurality of spaced apart transparent sections, and a pushsleeve is coupled to an element that is rotatable relative to the two pages. The pushsleeve extends in the pocket and has a coded image positioned to move beneath the window. A fold line is between the pushsleeve and the element to allow the pushsleeve to rotate relative to the element. The pushsleeve is movable between a first position in which the element is between the fold line and the window and a second position in which the fold line is between the element and the window. Movement of the pushsleeve between the first and second positions causes the coded image to move beneath the window. Rotation of the element away from the two pages causes the pushsleeve to advance into the pocket, and rotation of the element toward the two pages causes the pushsleeve to retract from the pocket.

An animated printed medium according to another embodiment includes four consecutive pages of unitary construction separated by folds. The second and third pages collectively define a spread with an uninterrupted gutter area, the first and second pages are generally adjacent to one another, and the third and fourth pages are generally adjacent to one another. At least one of the second and third pages has a window with a plurality of spaced apart transparent sections, and the page having the window defines a pocket with the generally adjacent page. A pushsleeve is separated from an adjoining page by a fold line, and the adjoining page is the first page or the fourth page. The pushsleeve extends in the pocket and has a coded image positioned to move beneath the window. The pushsleeve is movable between a first position in which the adjoining page is between the fold line and the window and a second position in which the fold line is between the adjoining page and the window. Movement of the pushsleeve between the first and second positions causes the coded image to move beneath the window.

A greeting card or book according to an embodiment includes two pages that define a pocket therebetween. At least one of the pages has a window with a plurality of spaced apart transparent sections. A third page is coupled to at least one of the two pages. The third page and one of the two pages collectively define a spread with an uninterrupted gutter area. A pushsleeve is coupled to an element rotatable relative to the two pages. The pushsleeve extends in the pocket and has a coded image positioned to move beneath the window. A fold line is between the pushsleeve and the element to allow the pushsleeve to rotate relative to the element. Graphics are located along the gutter area. The pushsleeve is movable between a first position in which the element is between the fold line and the window and a second position in which the fold line is between the element and the window. Movement of the pushsleeve between the first and second positions causes the coded image to move beneath the window.

BRIEF DESCRIPTION OF THE DRAWINGS

FIG. 2*a* is a side view of the animated printed medium of FIG. 1 in a first position.

FIG. 2*b* is a side view of the animated printed medium of FIG. 1 in a second position.

FIG. 2*c* is a side view of the animated printed medium of FIG. 1 in a third position.

DETAILED DESCRIPTION

Figure 1:
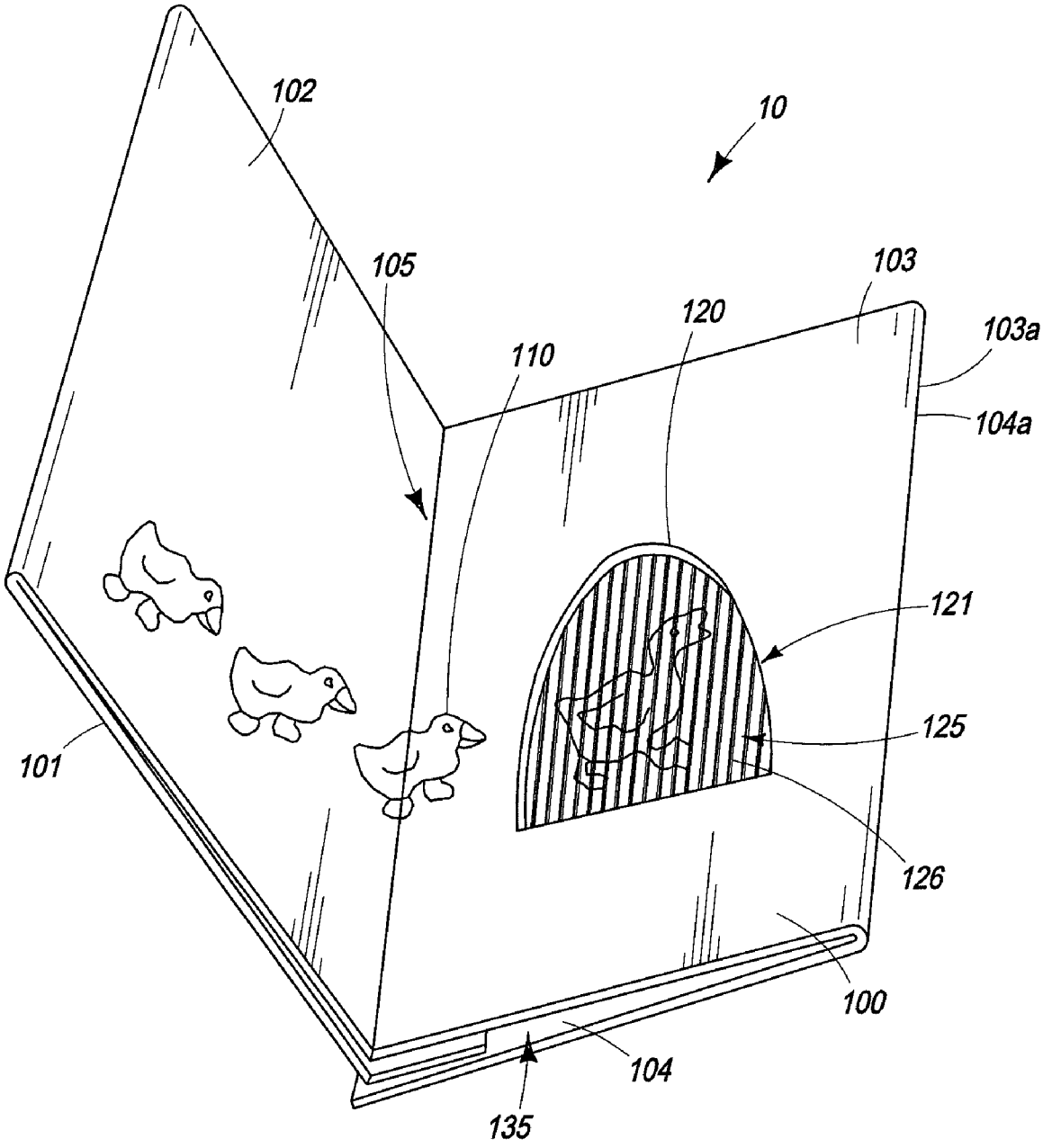
FIG. 1 is a perspective view of an animated printed medium according to an embodiment.

FIGS. 1 through 3*b* show one embodiment of an animated printed medium 10 (e.g., a greeting card, book, etc.). Animated printed medium 10 has four pages 100 (i.e., page 101, page 102, page 103, page 104), but it should be understood that more pages may be included. The first and last pages 100 (e.g., pages 101, 104) may be referred to herein as the "cover", and the pages 100 therebetween (e.g., pages 102, 103) may be referred to herein as "inner panels". Gutter areas 105 (also referred to herein as "fold lines") may be defined between consecutive pages 100 that define a spread (i.e., pages that may be simultaneously viewed), as shown between pages 102 and 103 in FIG. 1.

Graphics 110 may be printed, adhered to, or otherwise provided on the pages 100, as is well known in the art, and graphics 110 may optionally be located adjacent or along the gutter areas 105, so long as those graphics 110 do not prevent the pages 100 from pivoting along the gutter areas 105.

Figure 4A:
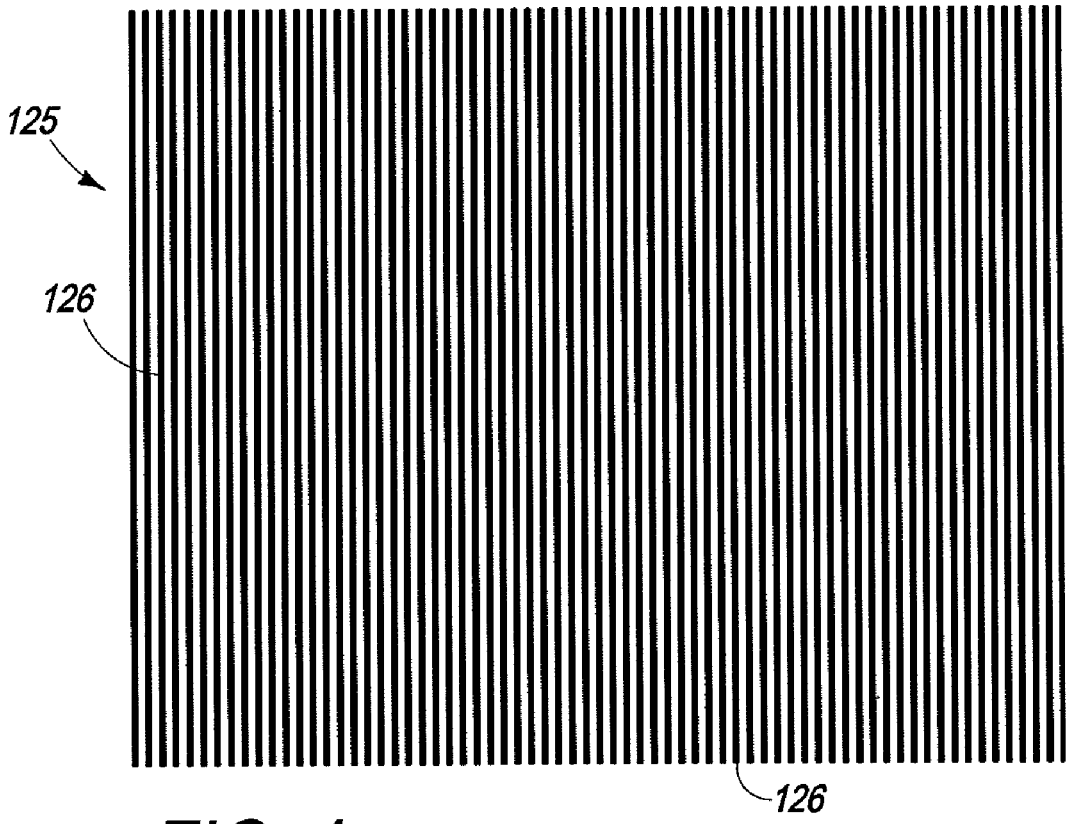
FIG. 4*a* is a font view of a transparent sheet having a plurality of lines according to an embodiment.
Figure 4B:
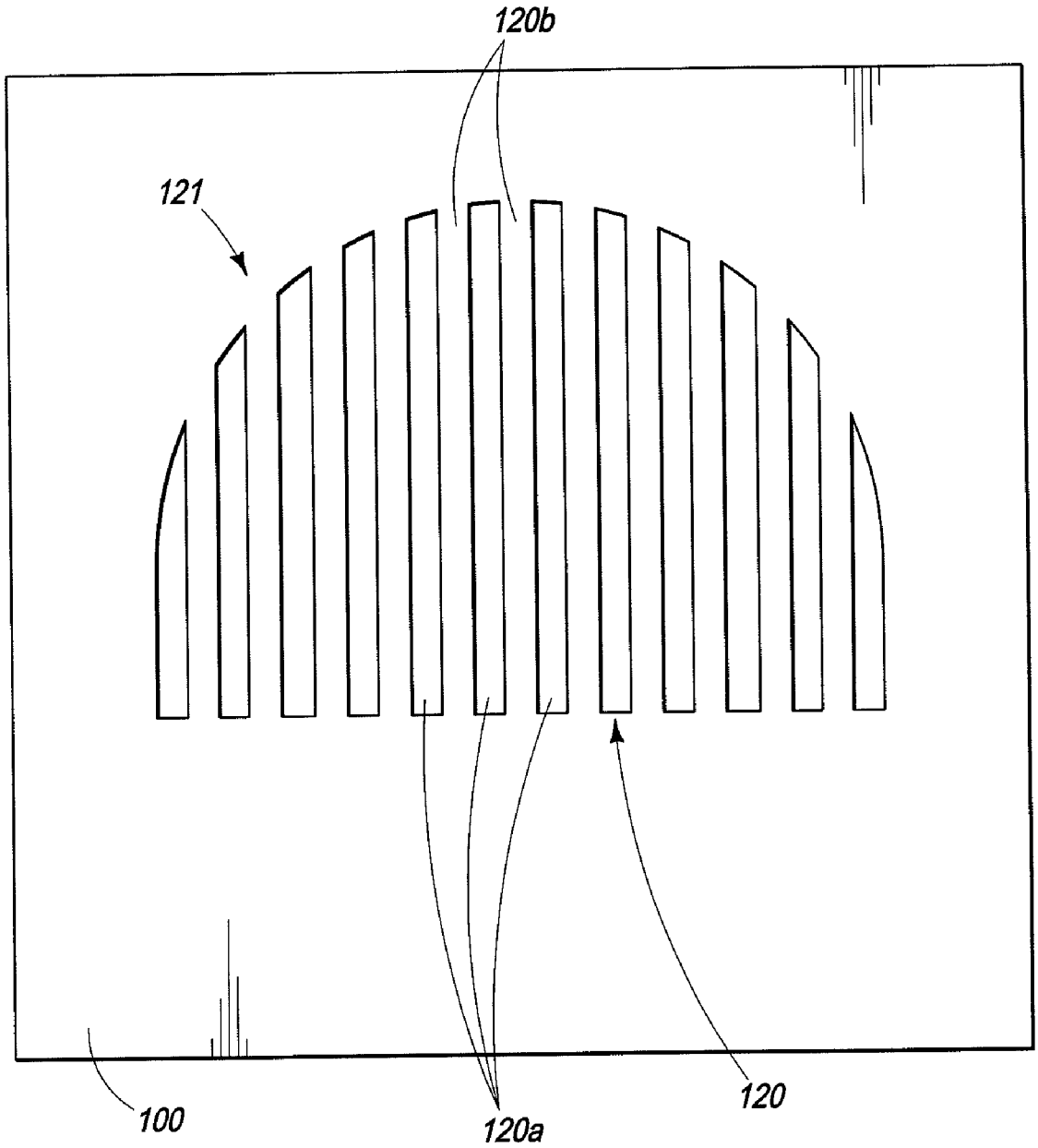
FIG. 4*b* is a front view of a cutout having a plurality of sections that define a plurality of lines from a page.

At least one page 100 defines a cutout 120, which may be created by any appropriate method, and a transparent sheet 125 with a plurality of lines 126 (preferably parallel straight lines, as shown in FIG. 4*a*) may be adjacent the cutout 120 and coupled to the page 100 by adhesive or any other appropriate fastener. In another embodiment, as shown in FIG. 4*b*, the transparent sheet 125 is omitted and the cutout 120 includes a plurality of sections 120*a* that define a plurality of lines 120*b* from the page 100. In both embodiments, the result is a window 121 with a plurality of spaced apart transparent sections.

Figure 5:
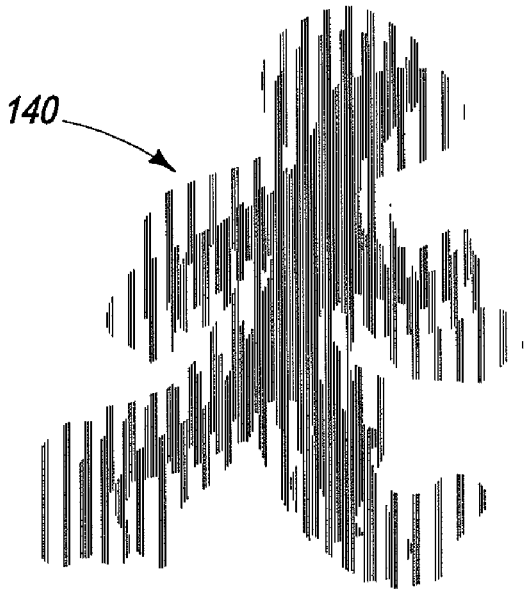
FIG. 5 is a front view of a coded image according to an embodiment.

A pushsleeve 130 is positioned beneath the window 121 in a pocket 135 defined by the page 100 having the window 121 and an adjacent page 100. For example, an edge 103*a* of page 103 is coupled to an edge 104*a* of page 104 to define the pocket between pages 103, 104 in animated printed medium 10. The pushsleeve 130 is pivotally coupled to an element that pivots relative to the pages that define the pocket 135. In animated printed medium 10, for example, the pushsleeve 130 is of unitary construction with the first page 101 and separated from the first page 101 by a fold line 131. The pivotal connection (e.g., fold line 131) between the pushsleeve 130 and the element (e.g., first page 101) is positioned such that the pivotal connection (e.g., fold line 131) is movable to a position inside the pocket 135 (FIG. 2*c*). In animated printed medium 10, this is accomplished by making first page 101 longer than second page 102. A coded image 140 (e.g., as shown in FIG. 5) is printed, adhered to, or otherwise provided on the pushsleeve 130 for movement beneath the window 121.

Pages 100 may be adhered or otherwise coupled together in a way that does not disrupt or prevent movement of the pushsleeve 130 in the pocket 135. For example, page 101 may be adhered to page 102 to form a single collective page that does not separate, and page 103 may be adhered to page 104 in areas 150*a* (FIG. 3*b*). Additional pages (noted above) may be traditional pages bound together at a spine and/or pages that form pockets 135 as described above, and additional pages may optionally include additional animation features (including, but not limited to, those set forth herein). Additional animation features (including, but not limited to, those set forth herein) may also be incorporated into a single page.

Figure 6A:
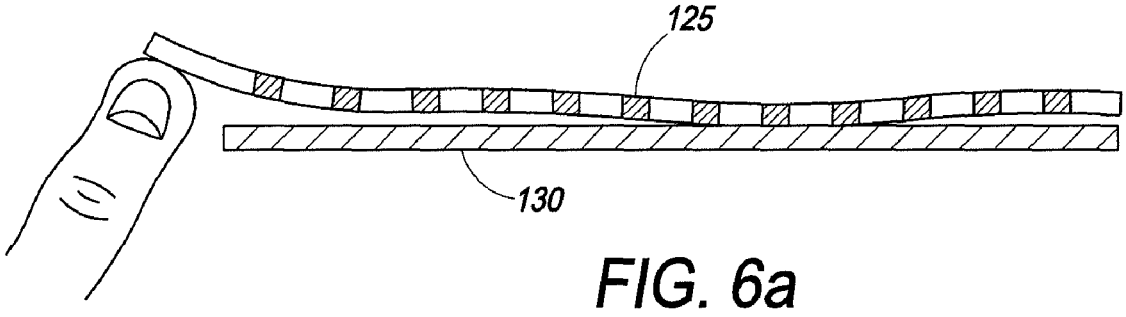
FIG. 6*a* is a side view of a transparent sheet adjacent a pushsleeve according to an embodiment.
Figure 6B:
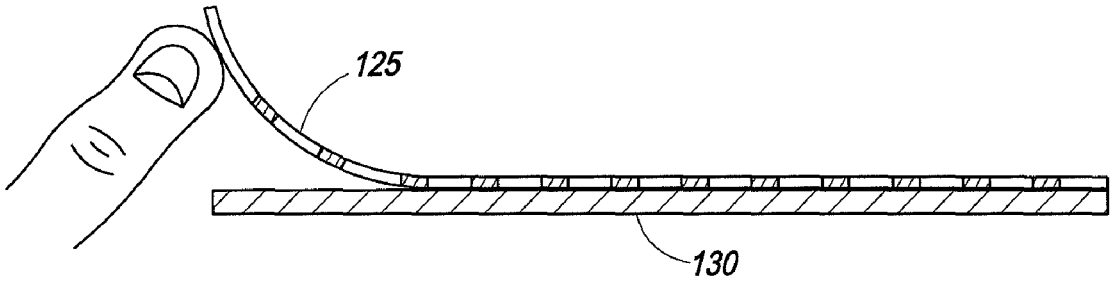
FIG. 6*b* is a side view of a transparent sheet adjacent a pushsleeve according to another embodiment.
Figure 6C:
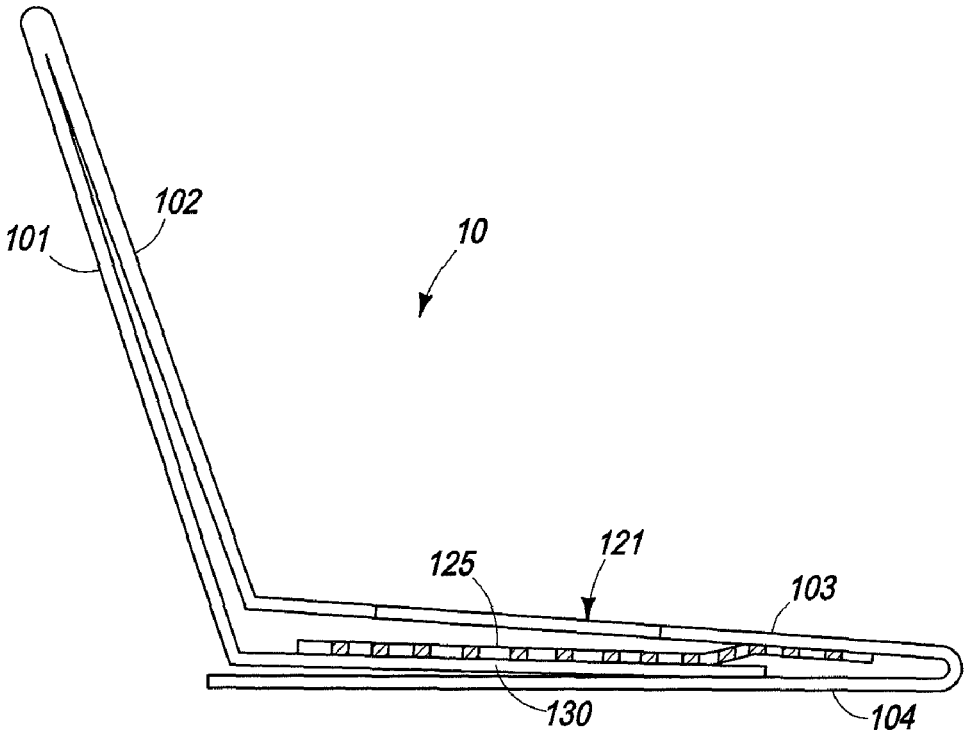
FIG. 6*c* is a side view of the animated printed medium of FIG. 1 showing a hingedly coupled transparent sheet.
Figure 7:
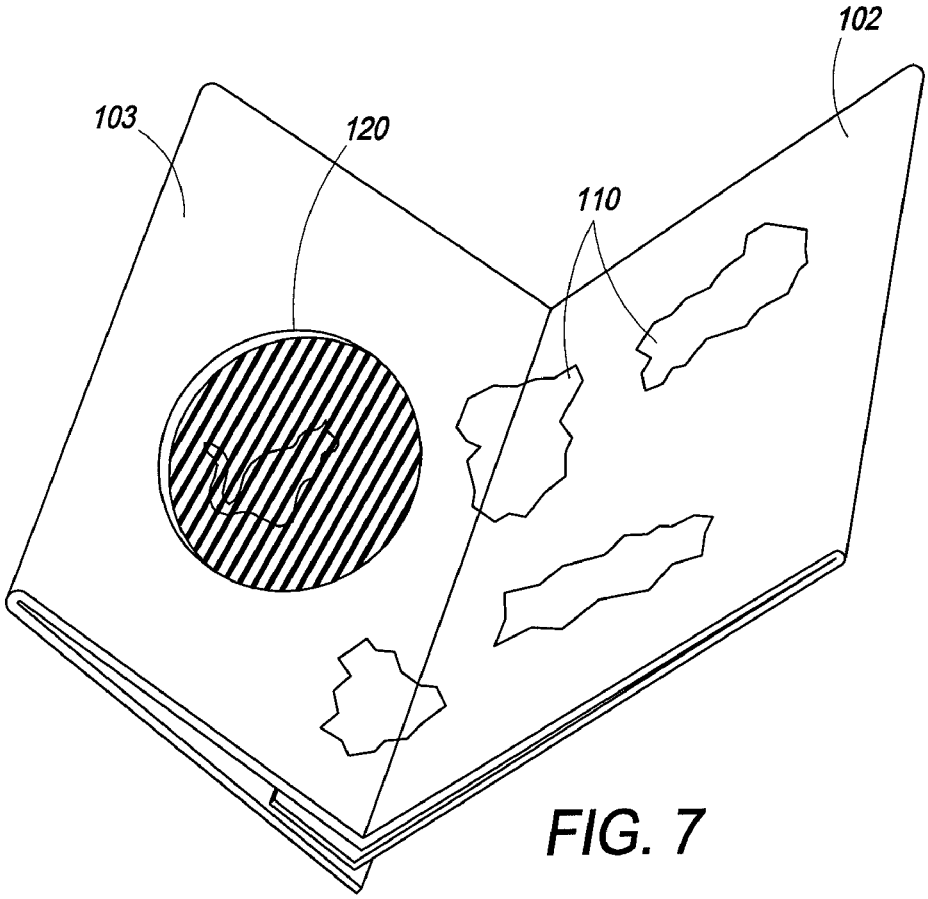
FIG. 7 is a perspective view of an animated printed medium according to another embodiment.

Various materials may be used to construct the animated print medium 10. For example, papers, cardstocks, vinyls, and/or other appropriate materials may be used for the pages 100 and/or the pushsleeve 130; acetate, cellophane, vinyl, and/or other transparent materials may be used for the transparent sheet 125; and ink or any other appropriate adornment may be used for the graphics 110 and the coded image 140. If a very thin material (e.g., 0.10 mm thick clear PVC) is used for the transparent sheet 125, the transparent sheet 125 may be drawn to—and lay against—the pushsleeve 130; this may be desirable since contact between the transparent sheet 125 and the pushsleeve 130 may enhance the animated effect of moving the pushsleeve 130 relative to the transparent sheet 125. This is shown in FIGS. 6*a* and 6*b*, for example, as the relatively thicker transparent sheet 125 in FIG. 6*a* tends to have air pockets and separate from the pushsleeve 130 at a slight nudge, while the relatively thinner transparent sheet 125 in FIG. 6*b* tends to relax and be drawn to the pushsleeve 130 even when nudged. In addition to, or alternately from, using a very thin material for the transparent sheet 125 to promote contact between the transparent sheet 125 and the pushsleeve 130, the transparent sheet 125 may be hingedly coupled to the page 100 (i.e., coupled to the page 100 along only one side of the transparent sheet 125) to allow the transparent sheet 125 to relax and pull away from the window 121 toward the pushsleeve 130, as shown in FIG. 6*c*.

In use, the animated print medium 10 may start such that the cover (e.g., pages 101, 104) is closed, and the front cover (e.g., page 101) may be opened (i.e., rotated) away from the rear cover (e.g., page 104), as shown in FIGS. 2*a* through 2*c*. This movement causes the pushsleeve 130 to move in the pocket 135 and the coded image 140 to pass beneath the window 121, which causes apparent animation viewable at window 121. Closing the cover causes the pushsleeve 130 to travel in the opposite direction relative to the window 121, which also causes apparent animation viewable at window 121.

Figure 3A:
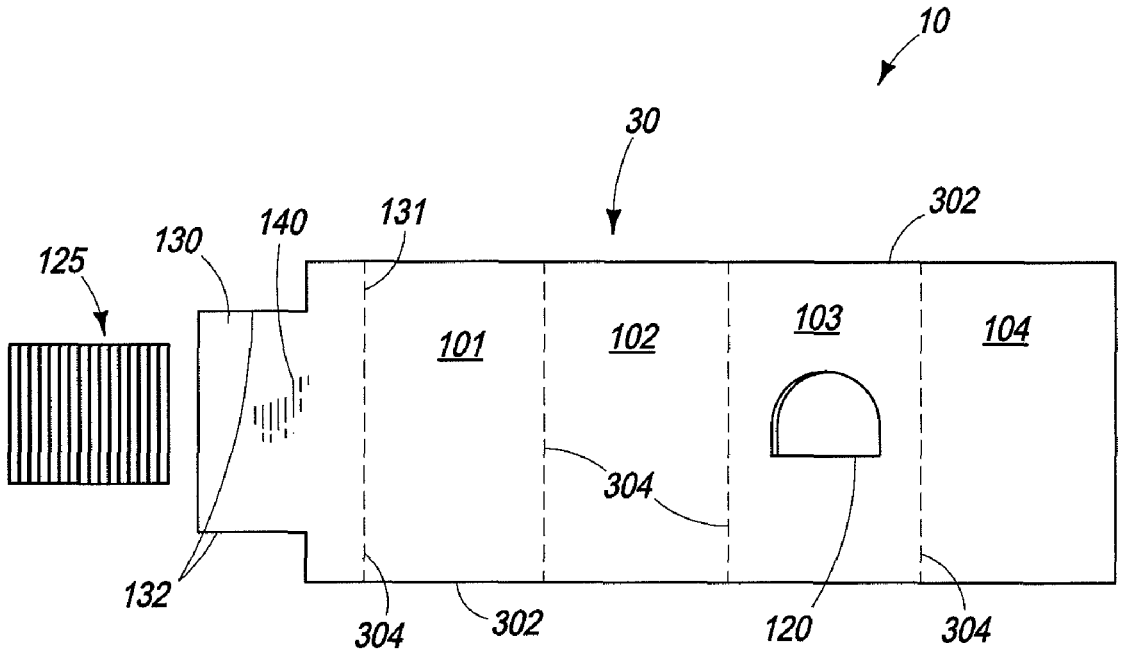
FIG. 3*a* is an unassembled view of the animated printed medium of FIG. 1.
Figure 3B:
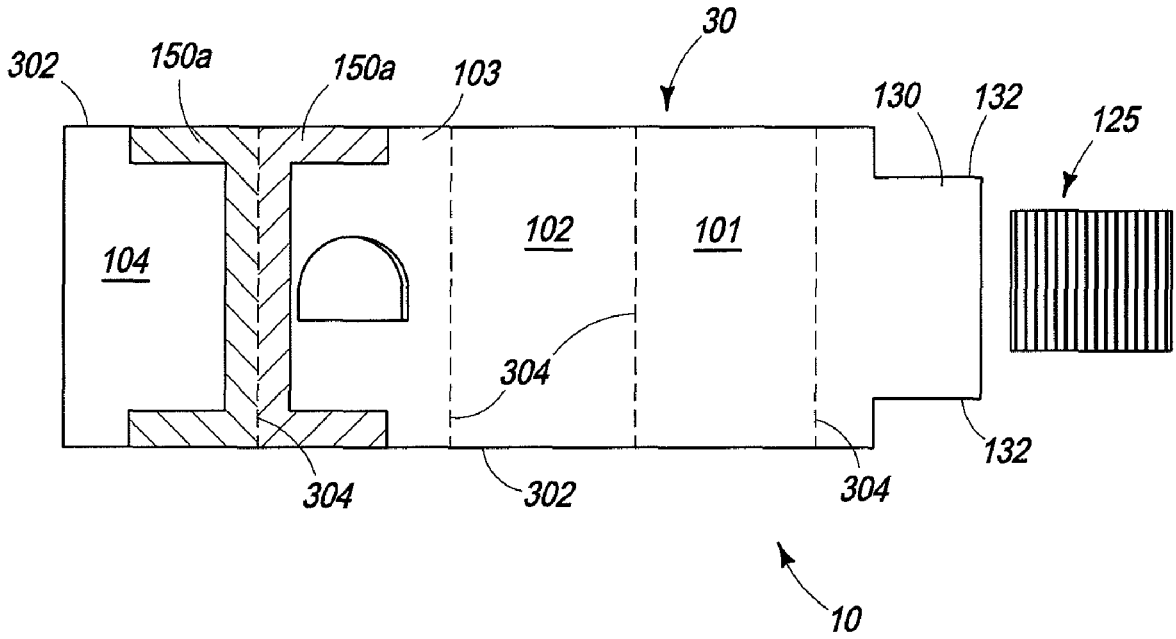
FIG. 3*b* is an unassembled view of the animated printed medium of FIG. 1.

As shown in FIGS. 3*a* and 3*b*, the animated print medium 10 may be constructed by cutting (or otherwise forming) a blank of material 30 that includes the cutout 120 and opposed edges 132 of the pushsleeve 130, which are inset from edges 302 of the blank of material 30. Fold lines 304 delineate the various pages 100 and the pushsleeve 130. The transparent sheet 125 is positioned along the page 100 having the cutout 120 (e.g., against or near a respective fold line 304, as shown in FIGS. 2*a* through 2*c*) and adhered to the page 100. One or more edge of the transparent sheet 125 may be adhered to the page 100. As set forth above, it may be desirable to adhere only one edge of the transparent sheet 125 to the page 100. Adhesive is applied to the pages 100 to couple areas 150*a* together and couple pages 101 and 102 together, the pushsleeve 130 is positioned behind the transparent sheet 125, and the pages 100 are folded together to achieve the configuration shown in FIGS. 1 through 2*c*. Graphics 110 and coded image 140 may be introduced at any appropriate step, and it may be preferable to introduce the graphics 110 and the coded image 140 before the fold lines 304 are formed and the adhesive is applied.

As will be appreciated by comparing FIG. 1 to FIG. 7, placement of graphics 110 and coded image 140 may determine where the animation occurs in the animated printing medium 10. In other words, by printing graphics 110 and coded image 140 relatively "upside down" compared to those in FIG. 1, the third page 103 in FIG. 1 may be considered to be the second page 102 in FIG. 7.

Figure 8:
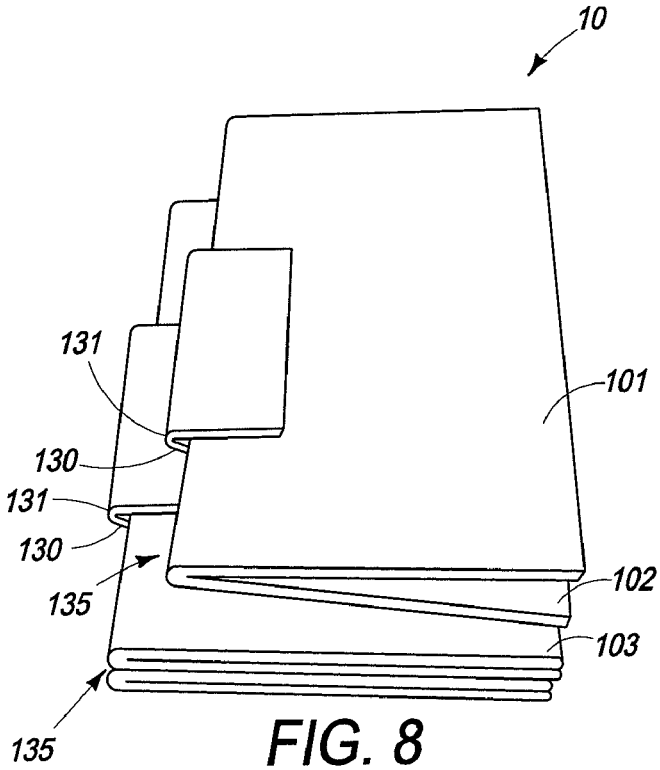
FIG. 8 is a perspective view of an animated printed medium according to yet another embodiment.

FIG. 8 shows that, while the printed medium 10 may be of unitary construction as set forth above, unitary construction is not required. Printed medium 10 shown in FIG. 8 is substantially identical to printed medium 10 discussed above, but the pushsleeve 130 is operatively adhered (or otherwise coupled) to the first page 101 and is not of unitary construction with the pages 100. Two pushsleeves 130 for movement in two pockets 135 are shown in FIG. 8. It should be understood that a cover or additional pages 100 may cover or obscure the visibility of the attachment of the pushsleeve(s) 130.

Animation effected by moving a coded image beneath a ruled transparent sheet is commonly known as moveable display animation and is shown, for example, in U.S. Pat. No.

2,367,967 to Schwartz, the contents of which are expressly incorporated herein by reference. However, while prior art devices have been proficient in utilizing the basic technique of sliding a coded image beneath a ruled transparent sheet to cause animation, prior art devices show the mechanics behind moving the coded image (see U.S. Pat. No. 2,367,967 to Schwartz, for example), which can be a distraction and may remove some of the marvel associated with the animation. In contrast, the animated printed medium 10 hides the mechanics behind moving the coded image 140 and allows full and complete sceneries (i.e., graphics 110) that surround the animated features (i.e., window 121) and extend across pages 100 (i.e., across gutter areas 105) to be created. In addition, the method of construction set forth herein is believed to be more commercially acceptable than prior art methods.

Figure 9:
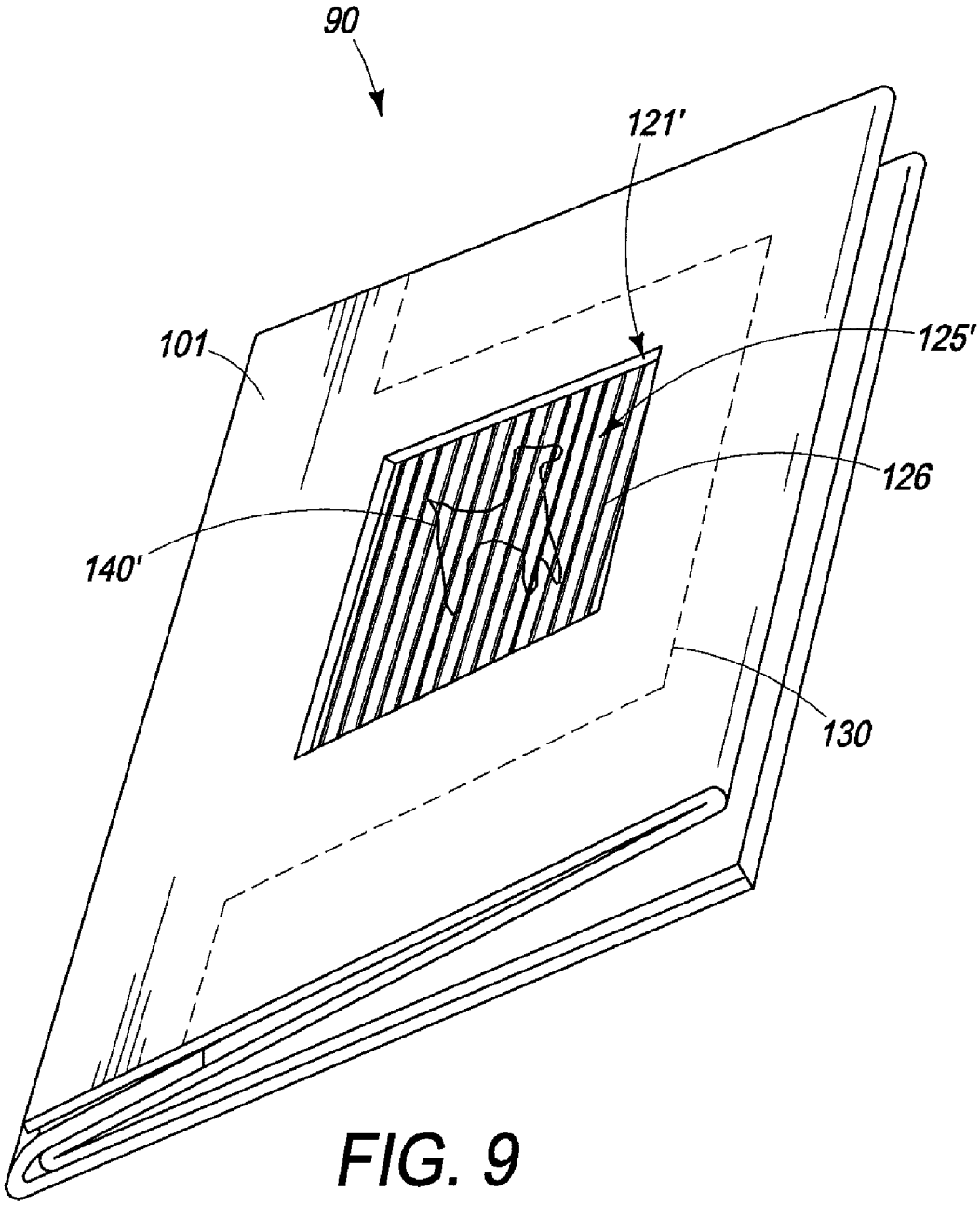
FIG. 9 is a perspective view of an animated printed medium according to still yet another embodiment.
Figure 10:
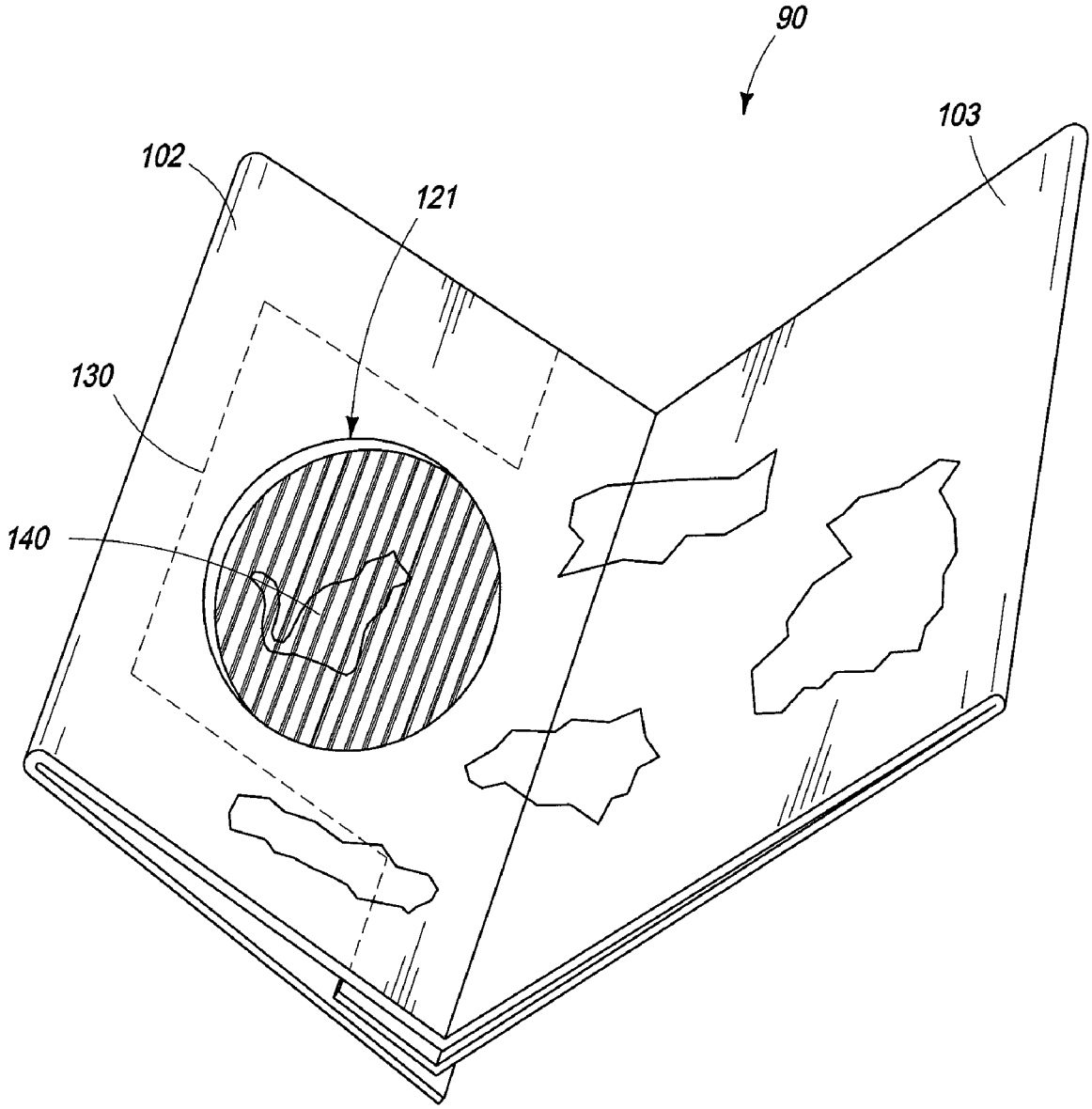
FIG. 10 is a perspective view of the animated printed medium of FIG. 9.

FIGS. 9 and 10 show an embodiment of an animated print medium 90 that is substantially similar to the animated print medium 10 but utilizes a single pushsleeve 130 to create two separate and distinct animations. For uniformity and brevity, reference numbers used in relation to the animated print medium 10 are again used to identify substantially similar elements in relation to the animated print medium 90. While the configuration of the animated print medium 90 shown in FIG. 9 is most similar to the animated print medium 10 shown in FIG. 8 (i.e., animation occurs at the second page 102), it should be understood that animation could alternately occur at the third page 103 (as shown in FIG. 1, for example) or any other page.

In animated print medium 90, the page 100 that defines the pocket 135 with the page 100 having the window 121 also defines a window 121'. The window 121' may be substantially aligned with the window 121, the window 121' may not overlap with the window 121 at all, or the window 121' may only partially overlap with the window 121. The window 121' may include a transparent sheet 125' with a plurality of lines 126' that is substantially similar to the transparent sheet 125, or the window 121' may otherwise be configured as set forth above regarding the window 121.

The pushsleeve 130 has an additional coded image 140' configured to travel beneath the window 121'. In other words, the additional coded image 140' is on the opposite side of the pushsleeve 130 than the coded image 140.

Movement discussed above relative to the animated print medium 10 and FIGS. 2*a* through 2*c* (i.e., opening and closing a page 100) similarly causes the additional coded image 140' to pass beneath the window 121, causing apparent animation viewable at window 121'.

Figure 11A:
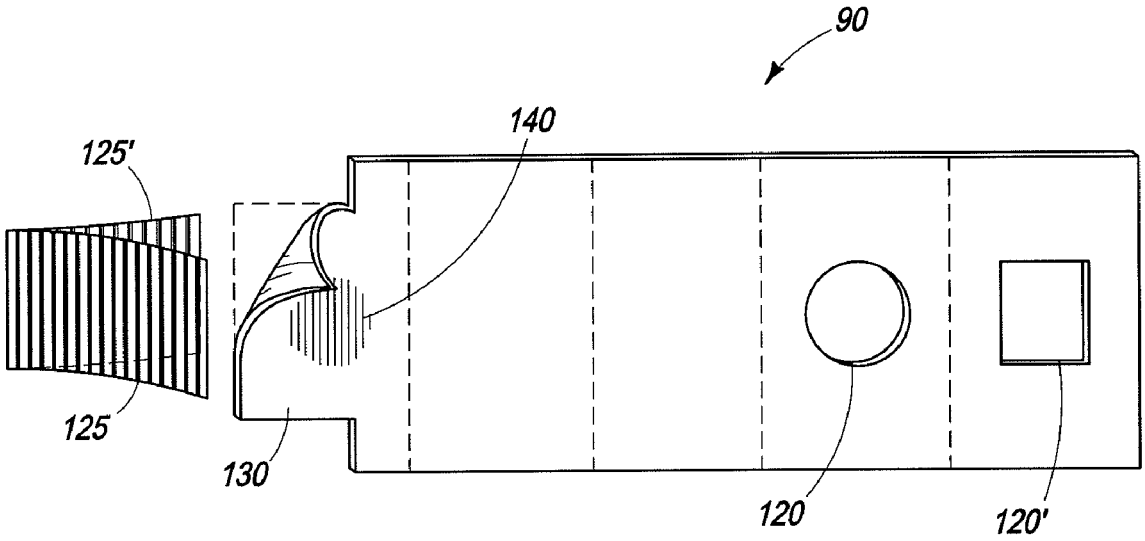
FIG. 11*a* is an unassembled view of the animated printed medium of FIG. 9.
Figure 11B:
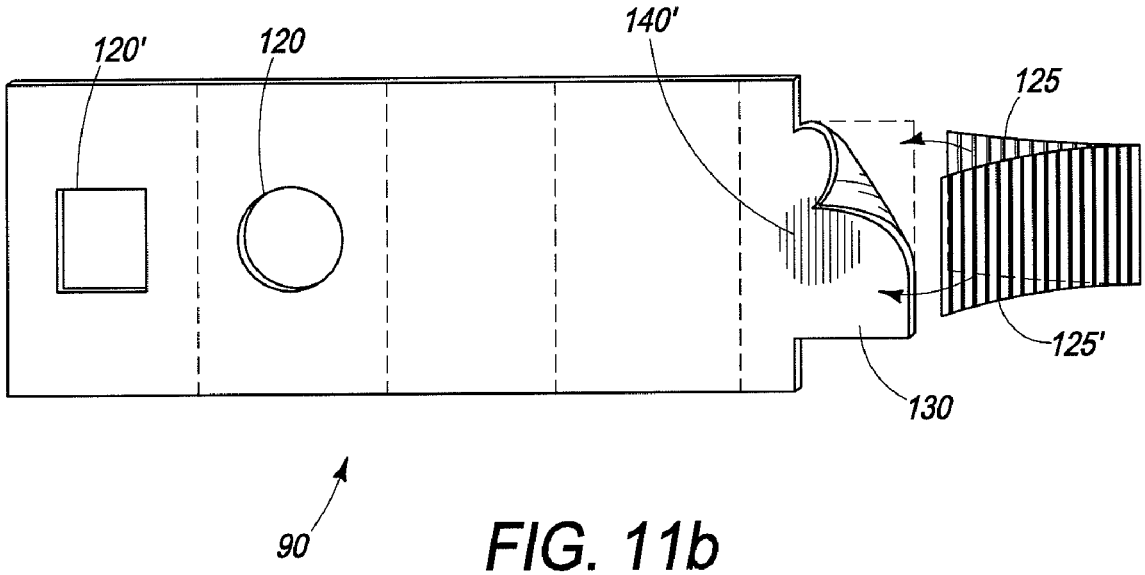
FIG. 11*b* is an unassembled view of the animated printed medium of FIG. 9.

As shown in FIGS. 11*a* and 11*b*, the animated print medium 90 may be constructed substantially similar to the animated print medium 10. Again, for uniformity and brevity, reference numbers used in relation to the animated print medium 10 and its construction are again used to identify substantially similar elements in relation to the animated print medium 90 and its construction. Notable differences between constructing the animated print medium 10 and the animated print medium 90 include the steps of cutting an additional cutout 120' in the blank of material 30, introducing the additional coded image 140' to the pushsleeve 130, and coupling the transparent sheet 125' beneath the additional cutout 120'. The transparent sheet 125 and the transparent sheet 125' may be separate and distinct elements, or may alternately be a single transparent sheet folded to envelop the pushsleeve 130 (as shown in FIGS. 11*a* and 11*b*).

FIGS. 12 through 16 show another embodiment of an animated printed medium 1200 (e.g., a greeting card, book, etc.). Animated printed medium 1200 has multiple pages 1201. The first and last pages 1201 may be referred to herein as the "cover", and the pages 1201 therebetween may be referred to herein as "inner panels", as is well understood in the art. Gutter areas 1205 (also referred to herein as "fold lines") may be defined between consecutive pages 1201 that define a spread (i.e., pages that may be simultaneously viewed), as shown between pages 1201 in FIG. 12.

Graphics 1210 may be printed, adhered to, or otherwise provided on the pages 1201, as is well known in the art, and graphics 1210 may optionally be located adjacent or along the gutter areas 1205, so long as those graphics 1210 do not prevent the pages 1201 from pivoting along the gutter areas 1205.

At least one page 1201 defines a cutout 1220, which may be created by any appropriate method, and a transparent sheet 1225 with a plurality of lines 1226 (preferably parallel straight lines) may be adjacent each cutout 1220 and coupled to the respective page 1201 by adhesive or any other appropriate fastener. In another embodiment, the transparent sheet 1225 is omitted and the cutout 1220 includes a plurality of sections that define a plurality of lines from the page 1201, as discussed above relative to FIG. 4. In both embodiments, the result is a window 1221 with a plurality of spaced apart transparent sections.

Figure 13:
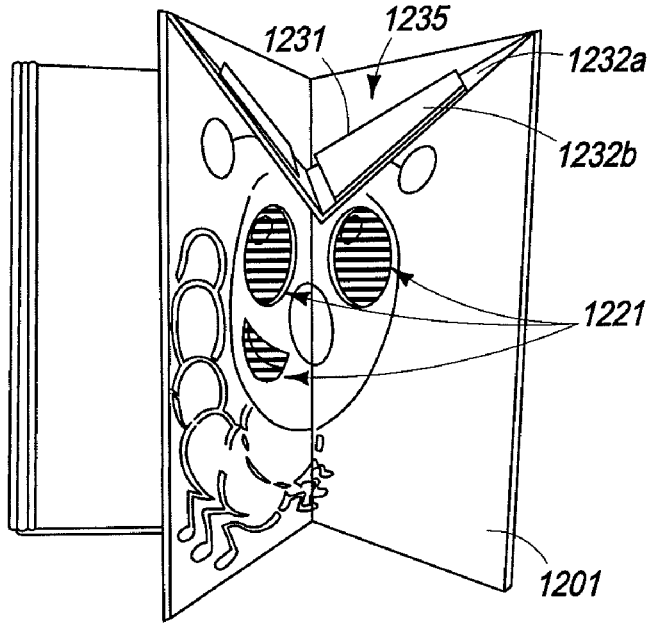
FIG. 13 is a perspective view of the animated printed medium of FIG. 12 in another position.
Figure 16:
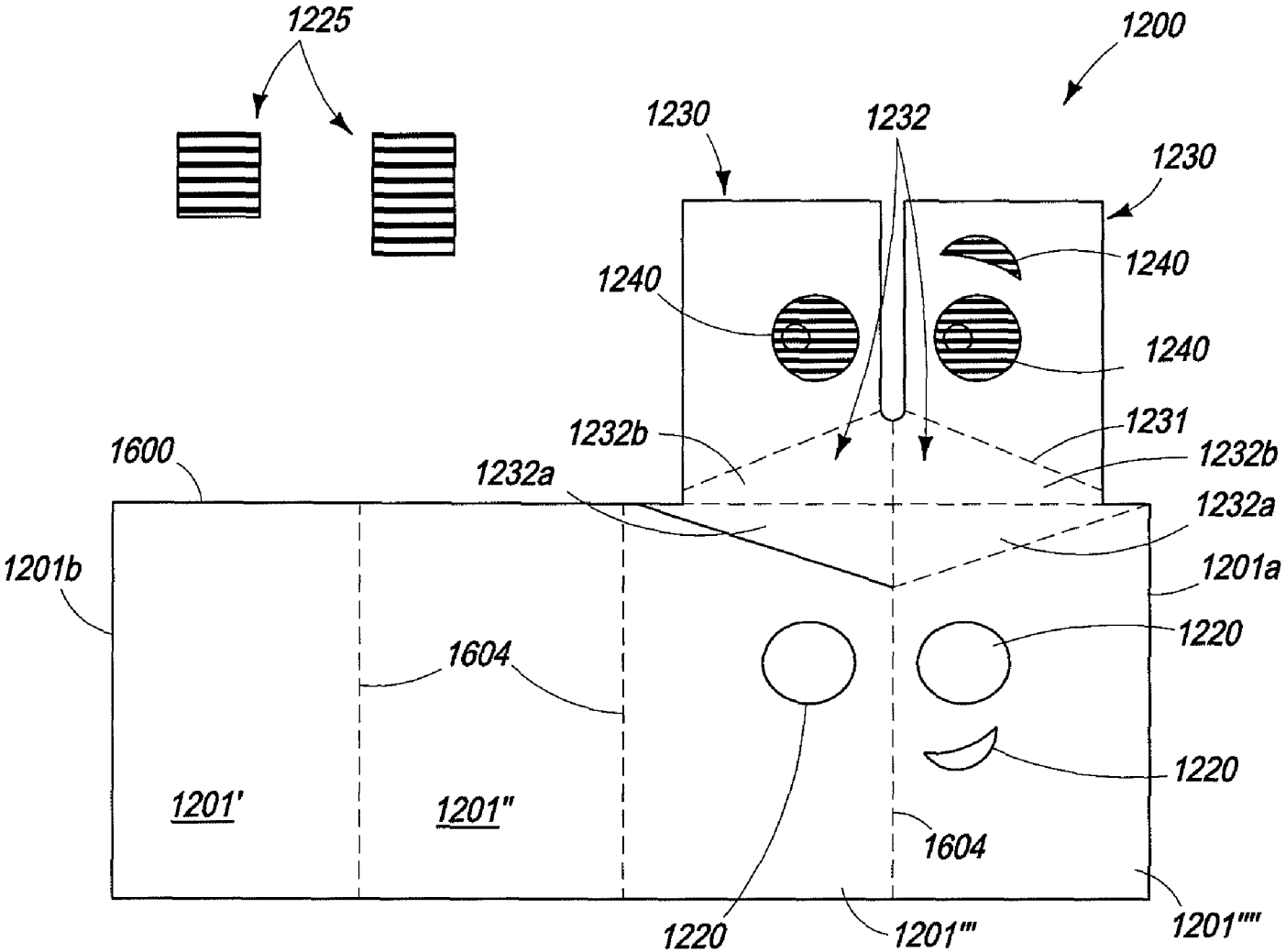
FIG. 16 is an unassembled view of the animated printed medium of FIG. 12.

For each page 1201 having a window 1221, a pushsleeve 1230 is positioned beneath the window 1221 in a pocket 1235 defined by the page 1201 having the window 1221 and an adjacent page 1201. For example, in animated print medium 1200, an edge 1201*a* of one page 1201 is coupled to an edge 1201*b* of another page 1201 to define a pocket between pages 1201' and 1201'''' and another pocket 1235 between pages 1201'' and 1201''' (FIGS. 13 and 16). Each pushsleeve 1230 is pivotally coupled to an element that pivots relative to the pages 1201 that define the corresponding pocket 1235. In animated printed medium 1200, for example, each pushsleeve 1230 is of unitary construction with the respective page 1201 that defines the corresponding window 1221 and is separated from that page 1201 by a fold line 1231 and an actuating section 1232.

Figure 15A:
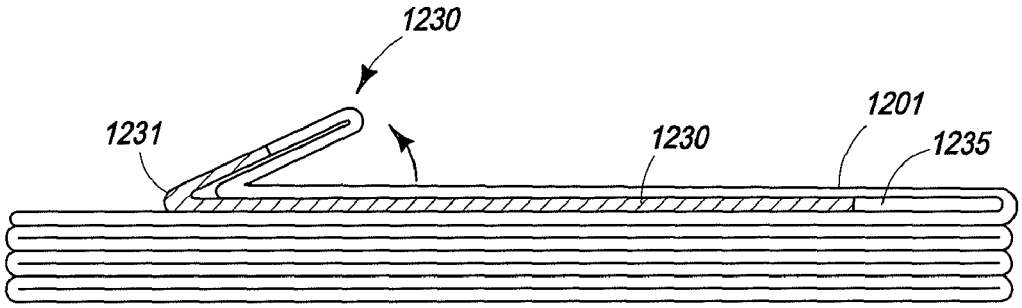
FIG. 15*a* is a side view of the animated printed medium of FIG. 12 in one position.
Figure 15B:
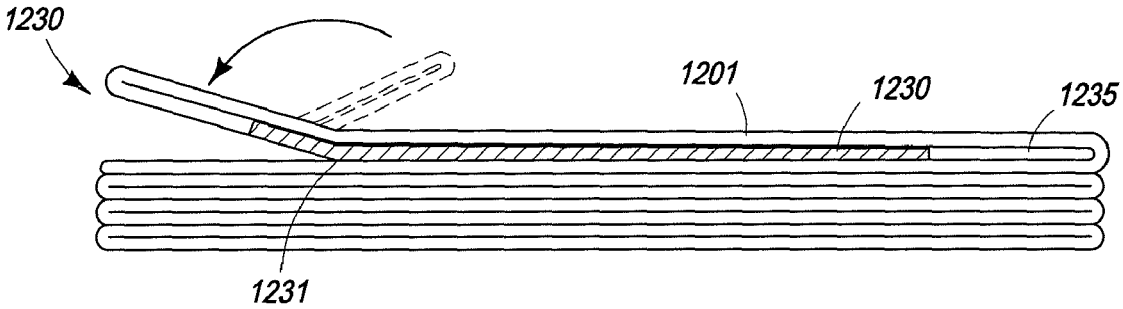
FIG. 15*b* is a side view of the animated printed medium of FIG. 12 in still another position.

The pivotal connection (e.g., fold line 1231) between the pushsleeve 1230 and the element (e.g., activating section 1232) is positioned such that the pivotal connection (e.g., fold line 1231) is movable to a position inside the pocket 1235 (FIG. 15*b*). In animated printed medium 1200, this is accomplished by making the activating section 1232 have a first portion 1232*a* adjacent the respective page 1201 that is not as long as a second portion 1232*b* between the first portion 1232*a* and the fold line 1231. A coded image 1240 (e.g., as shown in FIG. 16) is printed, adhered to, or otherwise provided on each pushsleeve 130 for movement beneath a respective window 1221.

Pages 1201 may be adhered or otherwise coupled together in a way that does not disrupt or prevent movement of a respective pushsleeve 1230 in a respective pocket 1235, and various materials may be used to construct the animated print medium 1200, such as those discussed above relative to the animated print medium 10.

Figure 12:
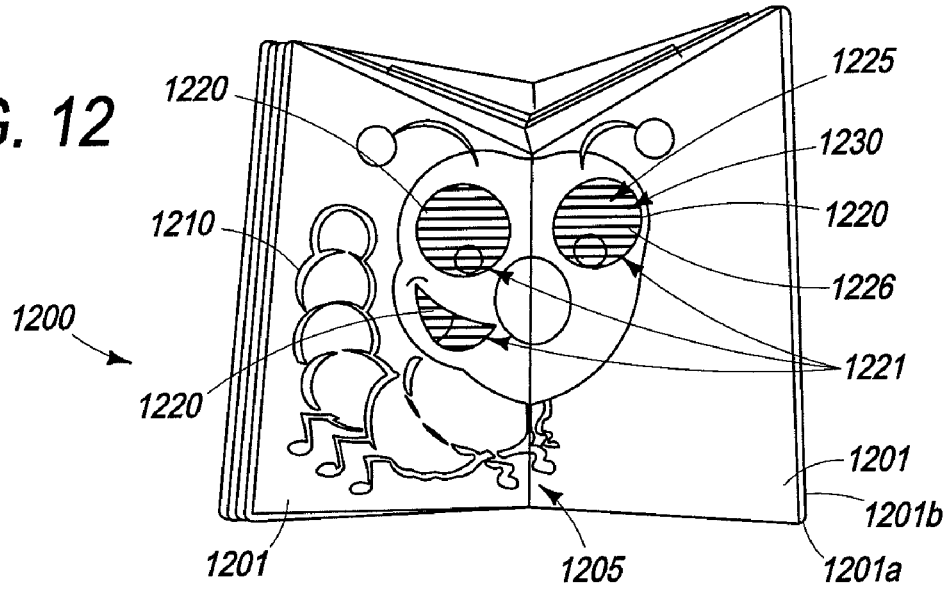
FIG. 12 is a perspective view of an animated printed medium according to an additional embodiment.
Figure 14:
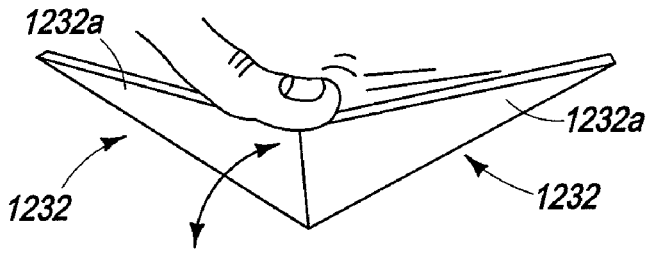
FIG. 14 is a perspective view showing movement of a portion of the animated printed medium of FIG. 12.

As shown in FIGS. 12 and 13, for example, consecutive pages 1201 that define a spread may both have at least one window 1221 and a respective pushsleeve 1230. If the activating sections 1232 for consecutive pages are coupled together (e.g., at respective first portions 1232*a*), pushing one or both activating sections 1232 (as shown in FIG. 14) may cause both pushsleeves 1230 to move relative to the windows 1221, causing an animated effect to be viewable through the windows 1221. This movement is specifically shown in FIGS. 15*a* and 15*b*. Further, if the activating sections 1232 are coupled together and at least one activating section first portion 1232*a* angularly extends from the gutter area 1205 (i.e., extends from the gutter area 1205 at an angle other than ninety degrees, as shown in FIG. 12 for example), simply moving the pages 1201 relative to one another may cause the activating sections 1232 to move, which in turn causes the pushsleeves 1230 to move relative to the windows 1221, resulting in an animated effect viewable through the windows 1221.

It should be understood that an embodiment that has a spread with only one page 1201 having a window 1221 and a pushsleeve 1230 may nevertheless be automated in a similar way (i.e., by moving the pages 1201 relative to one another) by coupling the activating section first portion 1232*a* to a folding element (similar to the activating section first portion 1232*a*, for example) of the other page 1201.

As shown in FIG. 16, the animated print medium 1200 may be constructed by cutting (or otherwise forming) a blank of material 1600 that includes the cutouts 1220, pushsleeves 1230, and activating sections 1232. Fold lines 1604 delineate the various pages 1201, the activating sections 1232, and the pushsleeves 1230. A transparent sheet 1225 is positioned along each page 1201 having a cutout 1220 and adhered thereto, and a single folded transparent sheet 1225 may be used instead of two individual transparent sheets 1225. One or more edge of each transparent sheet 1225 may be adhered to a page 1201. Adhesive may be applied to the pages 1201 to couple areas of the pages 1201 together, each pushsleeve 1230 is positioned behind a transparent sheet 1225, and the pages 1201 are folded together to achieve the configuration shown in FIGS. 12 and 13. Graphics 1210 and coded images 1240 may be introduced at any appropriate step, and it may be preferable to introduce the graphics 1210 and coded images 1240 before the fold lines 1604 are formed and adhesive is applied.

Additional pages (noted above) may be traditional pages bound together at a spine and/or pages that form pockets 1235 as described above, and additional pages may optionally include additional animation features (including, but not limited to, those set forth herein). Additional animation features (including, but not limited to, those set forth herein) may also be incorporated into a single page.

FIGS. 17 through 20 show another embodiment of an animated printed medium 1700 (e.g., a greeting card, book, etc.). Animated printed medium 1700 has multiple pages 1701. The first and last pages 1701 may be referred to herein as the "cover", and the pages 1701 therebetween may be referred to herein as "inner panels", as is well understood in the art. Gutter areas 1705 (also referred to herein as "fold lines") may be defined between consecutive pages 1701 that define a spread (i.e., pages that may be simultaneously viewed), as shown between pages 1701 in FIG. 17.

Graphics 1710 may be printed, adhered to, or otherwise provided on the pages 1701, as is well known in the art, and graphics 1710 may optionally be located adjacent or along the gutter areas 1705, so long as those graphics 1710 do not prevent the pages 1701 from pivoting along the gutter areas 1705.

At least one page 1701 defines a cutout 1720, which may be created by any appropriate method, and a transparent sheet 1725 with a plurality of lines 1726 (preferably parallel straight lines) may be adjacent each cutout 1720 and coupled to the respective page 1701 by adhesive or any other appropriate fastener. In another embodiment, the transparent sheet 1725 is omitted and the cutout 1720 includes a plurality of sections that define a plurality of lines from the page 1701, as discussed above relative to FIG. 4. In both embodiments, the result is a window 1721 with a plurality of spaced apart transparent sections.

Figure 20:
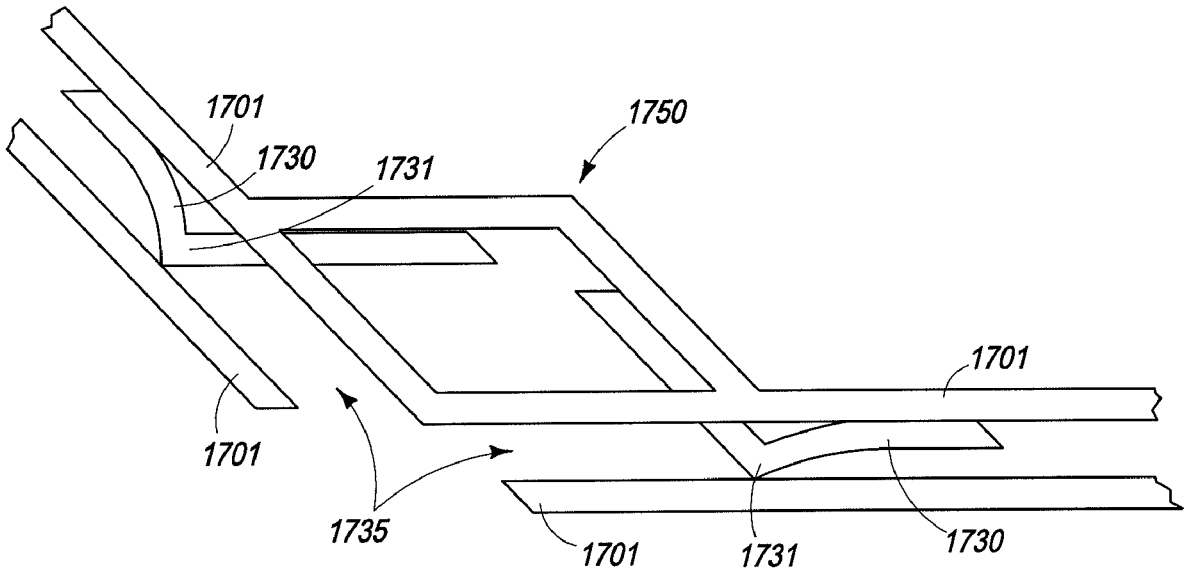
FIG. 20 is a partial side view of the animated printed medium of FIG. 17 in another position.

For each page 1701 having a window 1721, a pushsleeve 1730 is positioned beneath the window 1721 in a pocket 1735 defined by the page 1701 having the window 1721 and an adjacent page 1701. Each pushsleeve 1730 is pivotally coupled to an element that pivots relative to the pages 1701 that define the corresponding pocket 1735. In animated printed medium 1700, for example, each pushsleeve 1730 is coupled to a pop-up portion 1750. The pivotal connection (e.g., fold line 1731) between the pushsleeve 130 and the element (e.g., pop-up portion 1750) is positioned such that the pivotal connection (e.g., fold line 1731) is movable to a position such that the element (e.g., pop-up portion 1750) is between the pivotal connection (e.g., fold line 1731) and the gutter area 1705 (FIG. 20). A coded image 1740 (e.g., as shown in FIG. 18) is printed, adhered to, or otherwise provided on the pushsleeve 1730 for movement beneath the window 1721.

Pages 1701 may be adhered or otherwise coupled together in a way that does not disrupt or prevent movement of a respective pushsleeve 1730 in a respective pocket 1735, and various materials may be used to construct the animated print medium 1700, such as those discussed above relative to the animated print medium 10.

Figure 17:
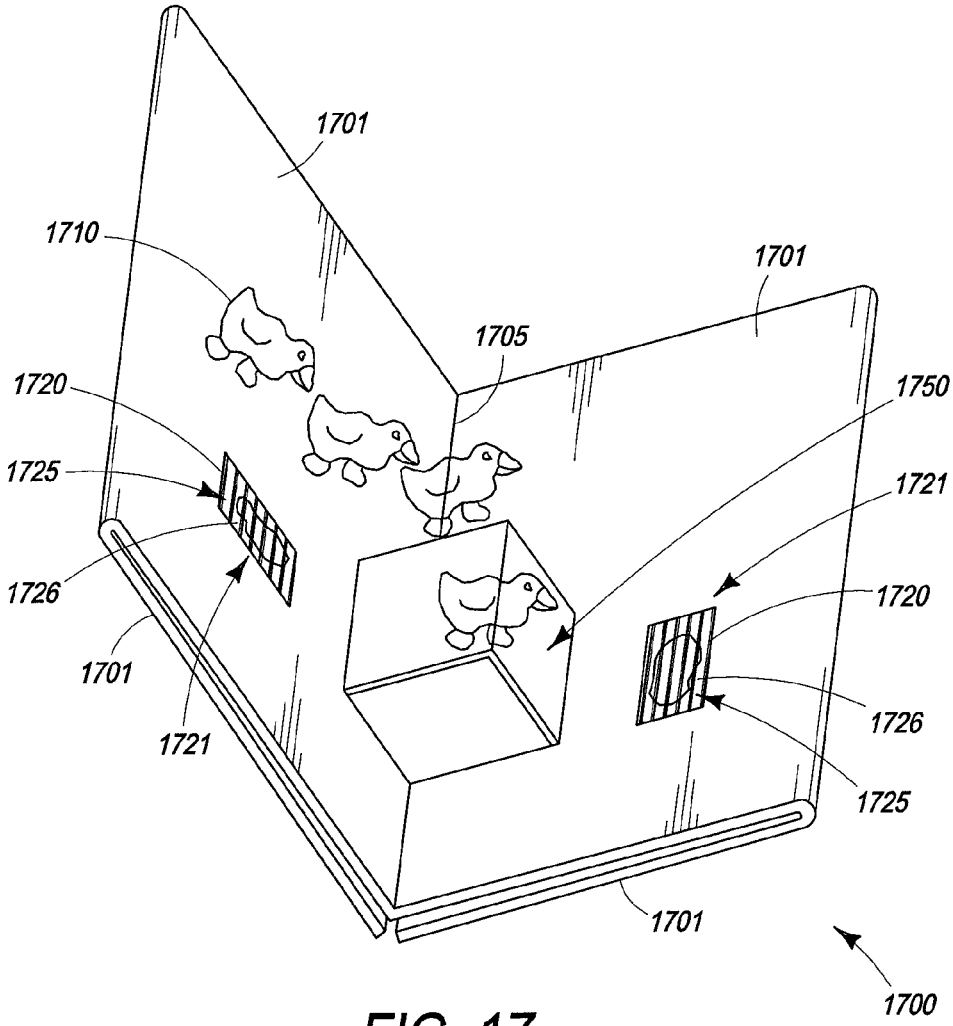
FIG. 17 is a perspective view of an animated printed medium according to a yet additional embodiment.
Figure 18:
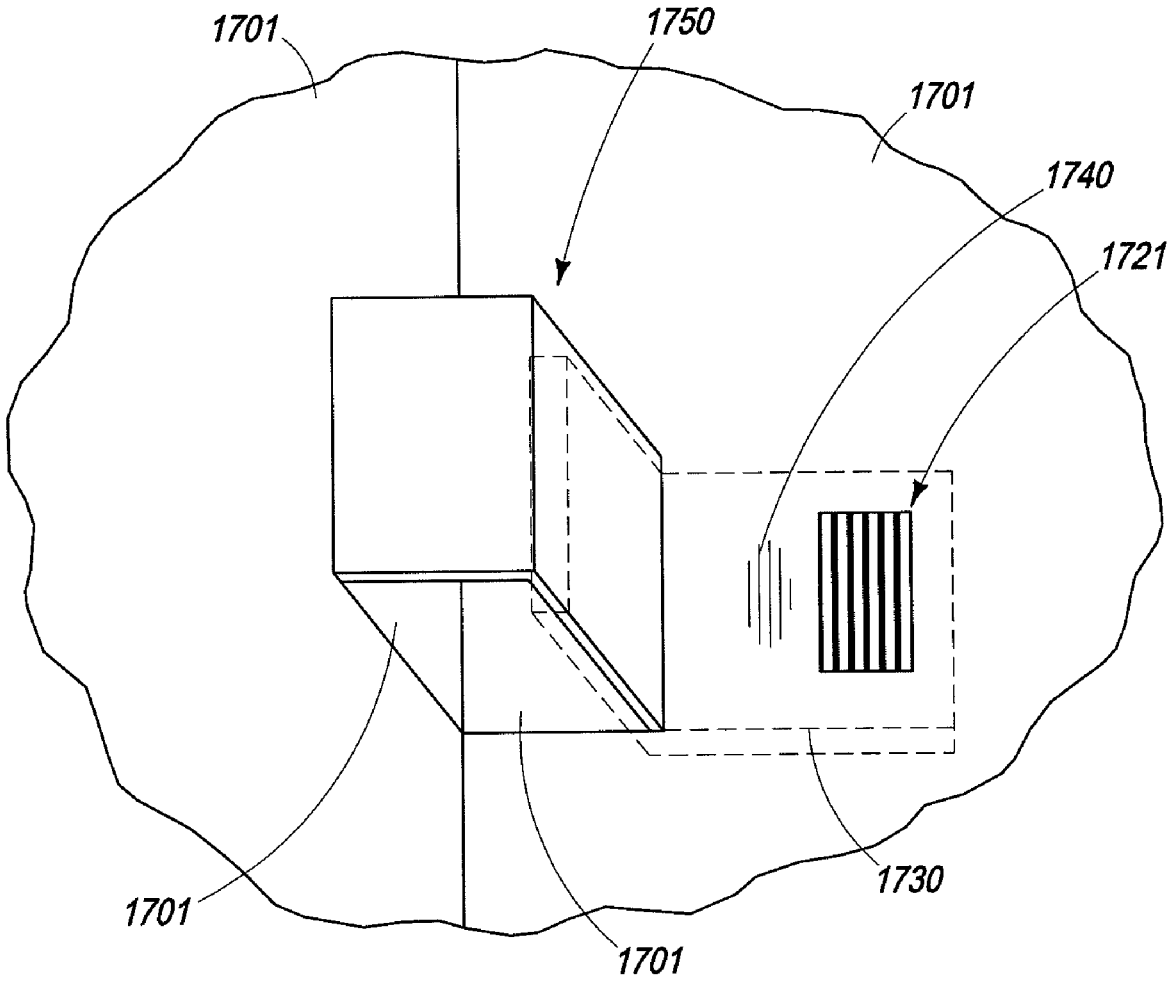
FIG. 18 is a magnified partial view of FIG. 17 with graphics removed for clarity.
Figure 19:
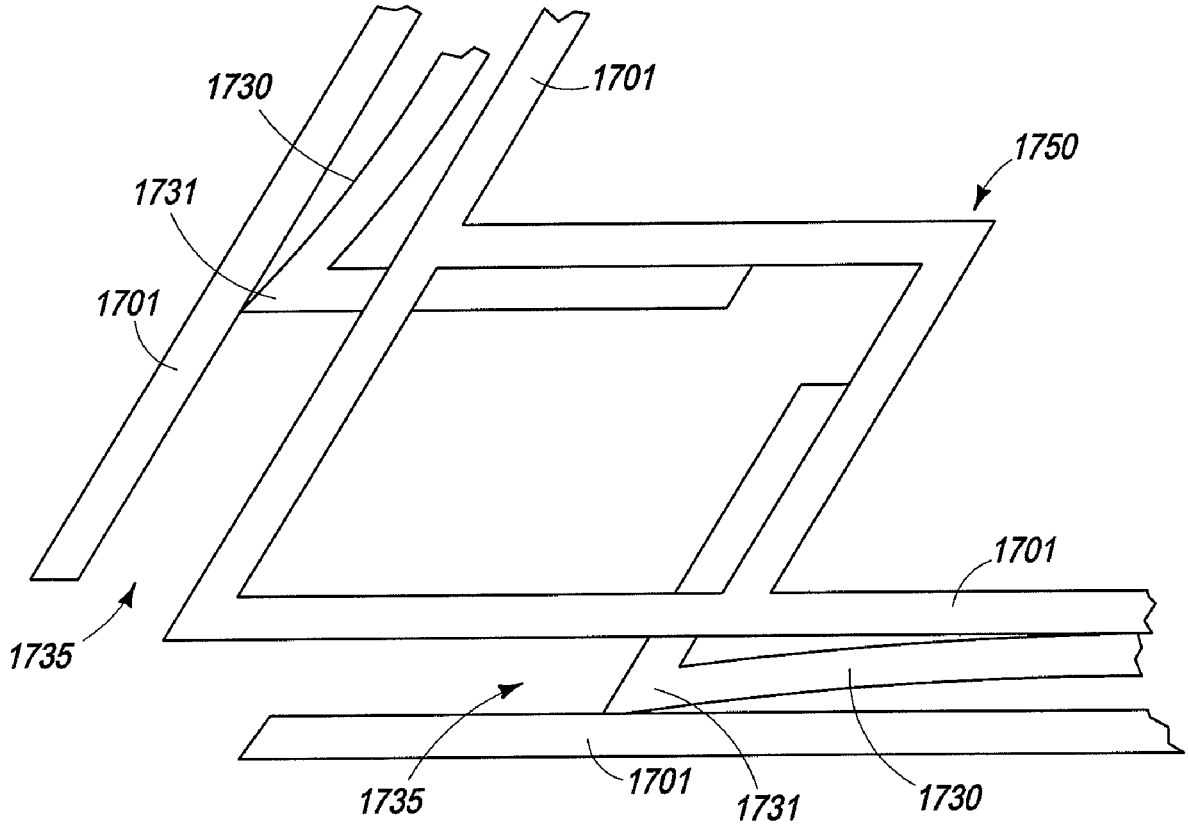
FIG. 19 is a partial side view of the animated printed medium of FIG. 17 in one position.

As shown in FIGS. 17 and 18, for example, consecutive pages 1701 that define a spread may both have at least one window 1721 and a respective pushsleeve 1730. If both pushsleeves 1730 are operatively coupled to a single element (e.g., pop-up portion 1750), movement of that element may cause both pushsleeves 1730 to move relative to the windows 1721, causing an animated effect to be viewable through the windows 1721. This movement is specifically shown in FIGS. 19 and 20. Further, if the pushsleeves 1730 are coupled to an element that moves automatically (e.g., pop-up portion 1750), simply moving the pages 1701 relative to one another may cause the pushsleeves 1730 to move relative to the windows 1721, resulting in an animated effect viewable through the windows 1721.

It should be understood that additional animation features (including, but not limited to, those set forth herein) may also be incorporated into a single page 1701 and/or other pages coupled to the pages 1701. FIG. 21, for example shows an animated printed medium 1700 combined with an animated printed medium 1200.

Those skilled in the art appreciate that variations from the specified embodiments disclosed above are contemplated herein and that the described embodiments are not limiting. The description should not be restricted to the above embodiments, but should be measured by the following claims.

I claim:

1. An animated printed medium, comprising:

two pages defining a pocket therebetween, at least one of the pages having a window with a plurality of spaced apart transparent sections; and a pushsleeve coupled to an element rotatable relative to the two pages, the pushsleeve extending in the pocket and having a coded image positioned to move beneath the window, a fold line being between the pushsleeve and the element to allow the pushsleeve to rotate relative to the element;

wherein the pushsleeve is movable between a first position in which the element is between the fold line and the window and a second position in which the fold line is between the element and the window;

wherein movement of the pushsleeve between the first and second positions causes the coded image to move beneath the window;

wherein rotation of the element away from the two pages causes the pushsleeve to advance into the pocket; and wherein rotation of the element toward the two pages causes the pushsleeve to retract from the pocket.

2. The animated printed medium of claim 1, wherein at least one window includes:

a cutout defined by a respective page; and a transparent sheet spanning the cutout and having a plurality of lines.

3. The animated printed medium of claim 2, wherein at least one of:

(a) the transparent sheet has a thickness of about 0.10 mm; or (b) the transparent sheet is coupled to a respective page along only one side of the transparent sheet.

4. The animated printed medium of claim 2, wherein the transparent sheet is constructed of at least one of acetate, cellophane, or vinyl.

5. The animated printed medium of claim 1, further comprising a third page coupled to at least one of the two pages, wherein:

the third page and one of the two pages collectively define a spread; and the pushsleeve is hidden except for through the window from a front view of the spread.

6. The animated printed medium of claim 1, further comprising a third page coupled to at least one of the two pages, wherein:

the third page and one of the two pages collectively define a spread with a gutter area; and graphics are located along the gutter area.

7. The animated printed medium of claim 1, wherein the element is one of a page, an activating section, or a pop-up portion.

8. The animated printed medium of claim 1, further comprising a third page coupled to at least one of the two pages, wherein:

the third page and one of the two pages collectively define a spread with a gutter area;

the element is an activating section having:

a first portion that extends angularly from the gutter area; and a second portion that extends between the first portion and the fold line, the second portion being longer than the first portion; and the pushsleeve, the first portion, the second portion, and the page having the window are of unitary construction separated by folds.

9. The animated printed medium of claim 1, further comprising a third page coupled to at least one of the two pages, wherein:

the third page and one of the two pages collectively define a spread with a gutter area; and movement of the third page relative to the other two pages causes the pushsleeve to move relative to the window.

10. The animated printed medium of claim 9, wherein:

the third page is of generally equal size as the other two respective pages; and graphics are located along the gutter area.

11. The animated printed medium of claim 1, wherein:

the two pages are first and second pages;

the first page defines the window;

the second page defines a second window;

the pushsleeve has a second coded image positioned to move beneath the second window; and movement of the pushsleeve between the first and second positions causes the second coded image to move beneath the second window.

12. An animated printed medium, comprising:

four consecutive pages of unitary construction separated by folds, the second and third pages collectively defining a spread with an uninterrupted gutter area, the first and second pages being generally adjacent to one another, the third and fourth pages being generally adjacent to one another, at least one of the second and third pages having a window with a plurality of spaced apart transparent sections, the page having the window defining a pocket with the generally adjacent page; and a pushsleeve separated from an adjoining page by a fold line, the adjoining page being the first page or the fourth page, the pushsleeve extending in the pocket and having a coded image positioned to move beneath the window;

wherein the pushsleeve is movable between a first position in which the adjoining page is between the fold line and the window and a second position in which the fold line is between the adjoining page and the window; and wherein movement of the pushsleeve between the first and second positions causes the coded image to move beneath the window.

13. The animated print medium of claim 12, wherein the pocket has upper and lower edges and the pushsleeve is at least partially recessed from the upper and lower edges.

14. The animated print medium of claim 12, wherein the window includes:

a cutout defined by a respective page; and a transparent sheet spanning the cutout and having a plurality of lines.

15. The animated printed medium of claim 14, wherein the transparent sheet is coupled to a respective page along only one side of the transparent sheet.

16. The animated printed medium of claim 12, wherein:

the pushsleeve is hidden except for through the window from a front view of the spread; and graphics are located along the gutter area.

17. A greeting card or book, comprising:

two pages defining a pocket therebetween, at least one of the pages having a window with a plurality of spaced apart transparent sections;

a third page coupled to at least one of the two pages, the third page and one of the two pages collectively define a spread with an uninterrupted gutter area;

a pushsleeve coupled to an element rotatable relative to the two pages, the pushsleeve extending in the pocket and having a coded image positioned to move beneath the window, a fold line being between the pushsleeve and the element to allow the pushsleeve to rotate relative to the element; and graphics located along the gutter area;

wherein the pushsleeve is movable between a first position in which the element is between the fold line and the window and a second position in which the fold line is between the element and the window; and wherein movement of the pushsleeve between the first and second positions causes the coded image to move beneath the window.

18. The greeting card or book of claim 17, wherein the window includes:

a cutout defined by a respective page; and a transparent sheet spanning the cutout and having a plurality of lines, the transparent sheet being coupled to a respective page along only one side of the transparent sheet.

19. The greeting card or book of claim 17, wherein the element is one of a page, an activating section, or a pop-up portion.

20. The greeting card or book of claim 17, wherein:

the element is an activating section having:

a first portion that extends angularly from the gutter area; and a second portion that extends between the first portion and the fold line, the second portion being longer than the first portion; and the pushsleeve, the first portion, the second portion, and the page having the window are of unitary construction separated by folds.

* * * * *